US005161599A

United States Patent [19]

Bell, deceased

[11] Patent Number: 5,161,599

[45] Date of Patent: Nov. 10, 1992

[54] FOUNDRY EQUIPMENT

[75] Inventor: Albert Bell, deceased, late of Sheffield, England, by Ruth M. Bell, administrator

[73] Assignee: William Cook plc, Sheffield, England

[21] Appl. No.: 534,043

[22] Filed: Jun. 6, 1990

[30] Foreign Application Priority Data

Jun. 8, 1989 [GB] United Kingdom ..... 8913168

[51] Int. Cl.[5] ..... B22C 15/00

[52] U.S. Cl. ..... 164/194; 108/66; 108/139; 164/326

[58] Field of Search ..... 164/412, 326, 130, 166, 164/194, 181; 425/540, 573, 453, 253, DIG. 201, 213, 575, 576, 266, 447, 452, 456, 432, 259, 261, 99, DIG. 108; 264/297.3, 297.6; 108/66, 94, 103, 139

[56] References Cited

U.S. PATENT DOCUMENTS

| | | | |
|---|---|---|---|
| 329,992 | 11/1885 | Appell | 108/139 |
| 669,696 | 3/1901 | Herreshoff | 164/326 |
| 1,270,212 | 6/1918 | Richeson | 108/103 |
| 1,973,005 | 9/1934 | Lemmon | 164/412 |
| 2,049,967 | 8/1936 | Luton | 164/326 |
| 2,351,774 | 6/1944 | McGowen | 264/297.6 |
| 2,547,275 | 4/1951 | Lyon | 425/445 |
| 2,570,717 | 10/1951 | Ronceray | 164/412 |
| 2,632,936 | 3/1953 | Skipper et al. | 425/DIG. 201 |
| 2,786,246 | 3/1957 | Jaeschke | 164/18 |
| 2,943,368 | 7/1960 | Peras | 164/326 |
| 3,122,800 | 3/1964 | Naffziger | 164/326 |
| 3,407,443 | 10/1968 | Beebee et al. | 425/DIG. 201 |
| 3,508,598 | 4/1970 | York | 164/137 |
| 3,802,487 | 4/1974 | Feller | 164/194 |
| 3,842,899 | 10/1974 | Hauser-Lienhard | 164/253 |
| 3,858,639 | 1/1975 | Larkin | 164/194 |
| 3,980,027 | 9/1976 | Maas | 108/103 |
| 4,060,364 | 11/1977 | Gras | 425/453 |
| 4,221,258 | 9/1980 | Richard | 164/326 |
| 4,237,796 | 12/1980 | Gordon et al. | 108/103 |
| 4,248,477 | 2/1981 | Netters | 108/94 |
| 4,295,515 | 10/1981 | Tordoff | 164/158 |
| 4,502,527 | 3/1985 | Brewer | 164/412 |

FOREIGN PATENT DOCUMENTS

| | | | |
|---|---|---|---|
| 3423199 | 2/1985 | Fed. Rep. of Germany . | |
| 2345367 | 10/1977 | France . | |
| 320342 | 2/1969 | U.S.S.R. | 164/412 |
| 1132455 | 3/1986 | U.S.S.R. | 425/575 |

*Primary Examiner*—Jay H. Woo
*Assistant Examiner*—Robert B. Davis
*Attorney, Agent, or Firm*—Trexler, Bushnell, Giangiorgi & Blackstone, Ltd.

[57] ABSTRACT

Foundry equipment (1) has a plurality of moulding tables (2) arranged radially on a carousel (3). A central work station (5) is provided for a machine operator (6) having access to control means (17, 10–12) to rotate the carousel (3), and hence the tables (2), in a selective manner beneath a discharge head (13) of a resin and sand mixing machine (14).

9 Claims, 1 Drawing Sheet

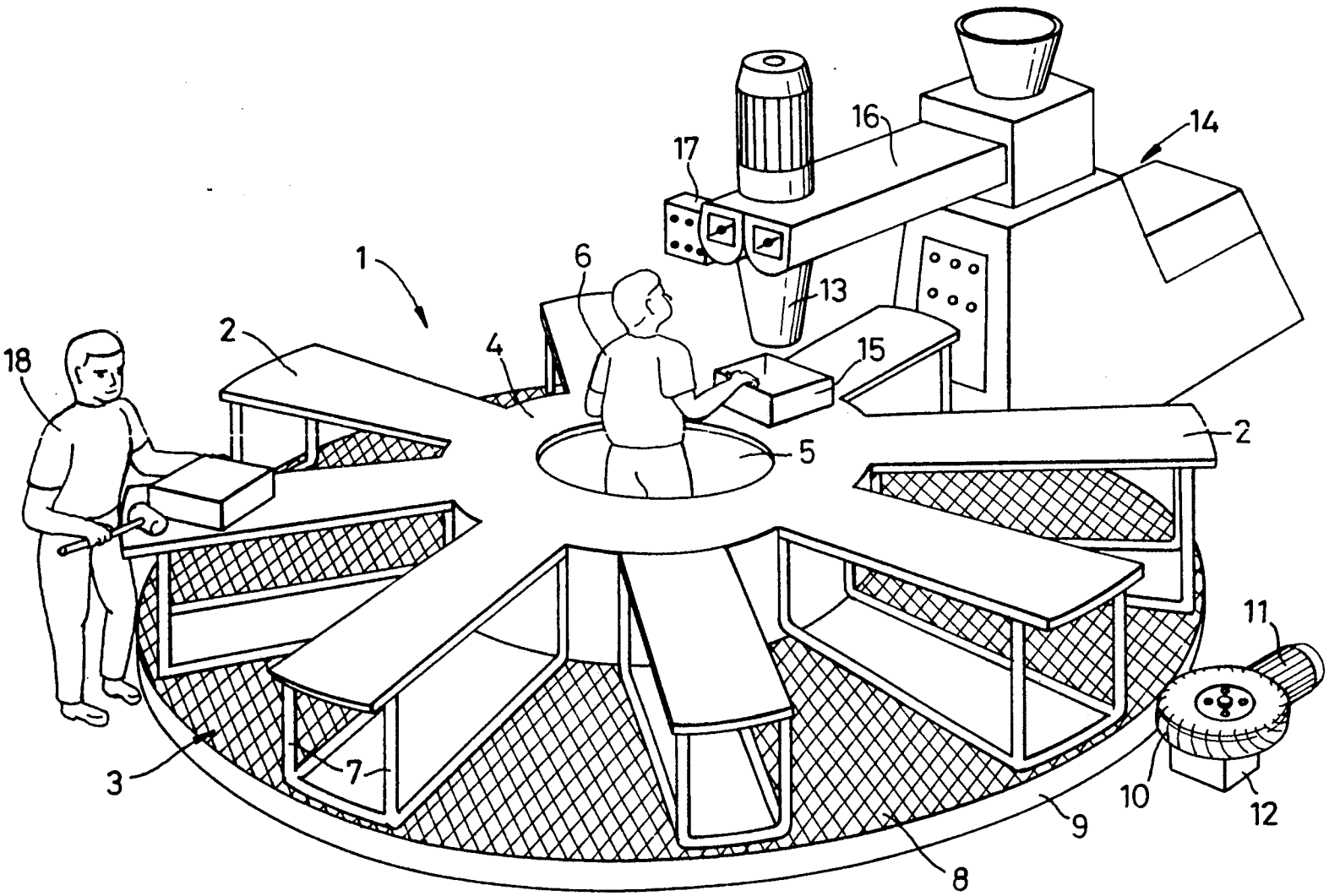
1
2
2
3
4
5
6
7
8
9
10
11
12
13
14
15
16
17
18

FOUNDRY EQUIPMENT

BACKGROUND OF THE INVENTION

This invention relates to foundry equipment for use in the production of foundry products, such as cores, of a sand/resin mix.

Widely used core etc production equipment comprises a mixing machine having a discharge head for the sand/resin mix swingable over an arc, under the control of a machine operator, with a plurality — usually four — moulding tables arranged around the arc, the operator swinging the head over selected tables to discharge an appropriate quantity of mix into a mould, which is then left to cure before the core etc can be stripped from the mould, during which time the head is swung to a discharge position above another table.

However, as the arc is finite, the number of tables that can be located within the arc is restricted, usually to four. This places restrictions on production, particularly if relatively long curing times are involved before a mould/core can be handled, stripped and removed to provide room to mould the next core etc.

SUMMARY OF THE DISCLOSURE

According to a first aspect of the present invention, there is provided foundry equipment comprising a plurality of moulding tables arranged radially on a carousel, with a central work station for a machine operator, and control means to rotate the carousel, and hence the tables, in a selective manner beneath a discharge head of a resin/sand mixing machine.

According to a second aspect of the invention, there is provided foundry equipment comprising, in combination, a sand resin mixing machine having a discharge head located above a plurality of moulding tables arranged radially on a carousel, with a central work station for a machine operator, and control means to rotate the carousel, and hence the tables, in a selective manner beneath the discharge head.

Thus, the foundry equipment in accordance with the invention, departs from conventional equipment in that the moulding tables are rotatable about the axis of the carousel, while the moulding machine, and in particular its discharge head, is static, to provide substantially increased production of multiples of core boxes, sizes and weights. Thus the operator, after completion of a moulding, activates the control means to rotate the table over a prescribed arc, to remove from beneath the discharge head a table carrying a filled mould, and to present beneath the discharge head a table carrying the next mould requiring filling.

In practice, with the equipment in accordance with the invention, eight moulding tables can be arranged at 45° spacings, which provides the possibility of virtually doubling the production of cores of a variety of sizes and weight. Conveniently, the moulding tables radiate from an inner, annular table area, the centre of which provides the work station.

The moulding tables are naturally located at a convenient working height for the machine operator and may be supported on legs extending upwards from a circular base plate, the underside of which is in contact with bearing means. Rotation of the carousel is conveniently by a friction drive e.g. a rubber tire, from an electric motor, and is reversible.

At least one radial moulding table is conveniently readily releasable from the carousel e.g., by providing locating pegs and receiving holes, so that, the carousel can accommodate oversize moulds when required.

BRIEF DESCRIPTION OF THE DRAWINGS

The invention will now be further described, in greater detail, by way of example, with reference to the accompanying drawing which is a perspective view of the foundry equipment and machine in accordance with the first and second aspects of the invention, respectively.

DETAILED DESCRIPTION OF THE INVENTION

In the drawing, foundry equipment 1, in accordance with the first aspect of the invention comprises eight moulding tables 2 spaced at 45° arranged on a carousel 3 radiating from an inner, annular table area 4, a centre 5 of which provides a work station for the machine operator 6. In detail, each table 2 is supported at a convenient working height on legs 7 extending upwards from a circular base plate 8, the underside of which is supported on suitable bearing means (not shown) for rotation about a vertical axis under the control of the operator 6, and a circumferential edge 9 of which is in frictional driving contact with a rubber tire 10 rotatable about a vertical axis, and an associated electric drive motor 11 and an interposed speed reduction, reversible gearbox 12.

The mould tables 2 are adapted to be brought individually beneath a static, elevated discharge head 13 of a sand resin moulding machine 14 which, in combination with the carousel 1 etc constitutes the second aspect of the invention. The head 13 discharges sand resin mixes, under the control of the operator 6, into a mould box 15 supported on whichever table 2 is beneath the head 13. The latter is supported at one end of a cantilever arm 16 and for purposes of control, the end of that arm is also provided with a bank of control switches, buttons (17) etc., within easy reach of the operator 6.

After the filling of a mould box 15, the drive motor 11 is activated to rotate the carousel and hence the mould tables to present a fresh mould box beneath the head 13 and to rotate the filled mould box to a curing area to allow sufficient curing time, after which a further operative 18 is able to knock the moulds from the boxes, in the usual manner.

To provide for enhanced height and size versatility, at least one table 2 is removable.

What I claim is:

1. Foundry equipment comprising a carousel having an axis of rotation, and also having a rotatable, annular baseplate adapted to be located at floor level, a central work station provided on said carousel defined by an annular, horizontal table area, a centre of which serves to accommodate an operator, with said annular table area spaced upwardly from said baseplate at a convenient working height for said operator, a plurality of moulding tables mounted on, and upstanding from, said baseplate and radiating from said inner, annular table area, and each said moulding tables providing a horizontal support surface for mould boxes also at a convenient working height for said operator, and control means to rotate said carousel, and hence said annular table area and said moulding tables, in a selective manner beneath a discharge head of an associated foundry sand and resin mixing machine located outside said carousel.

2. Foundry equipment as claimed in claim 1, wherein eight moulding tables are arranged at 45° spacing.

3. Foundry equipment as claimed in claim 1, wherein a circular base plate constitutes part of said carousel, support legs extend upwardly from said base plate to support each of said moulding tables at a convenient working height, and an underside of said base plate is in contact with bearing means.

4. Foundry equipment as claimed in claim 1, wherein a reversible, friction drive is provided to rotate said carousel.

5. Foundry equipment as claimed in claim 4, wherein a rubber tire is incorporated in said drive.

6. Foundry equipment as claimed in claim 4, wherein an electric motor is incorporated in said drive.

7. Foundry equipment as claimed in claim 1, wherein at least one of said moulding tables is readily releasable from said carousel, so that the carousel can accommodate oversize mould boxes when required.

8. Foundry equipment as claimed in claim 7, wherein locating pegs are provided on said releasable moulding table and receiving holes for said pegs are provided in a circular base plate of said carousel.

9. A mixing machine for foundry sand and resin comprising a discharge head, in combination with a carousel having an axis of rotation, and also having a rotatable, annular baseplate adapted to be located at floor level, a central work station provided on said carousel defined by an annular, horizontal table area, a centre of which serves to accommodate an operator, with said annular table area spaced upwardly from said baseplate at a convenient working height for said operator, a plurality of moulding tables mounted on, and upstanding from said baseplate and radiating from said inner, annular table area, and each said moulding tables providing a horizontal support surface for mould boxes also at a convenient working height for said operator, and control means to rotate said carousel, and hence said annular table area and said moulding tables, in a selective manner beneath a discharge head of an associated foundry sand and resin mixing machine located outside said carousel.

* * * * *